US009017050B2

(12) United States Patent
Ginies et al.

(10) Patent No.: US 9,017,050 B2
(45) Date of Patent: Apr. 28, 2015

(54) SCROLL REFRIGERATION COMPRESSOR WITH ANTI-RETURN DEVICE

(75) Inventors: Pierre Ginies, Sathonay Village (FR); Mickael Bron, Saint Bonnet de Mure (FR); Dominique Gross, Jassans Riottier (FR); Stephane Watts, Lyons (FR); Franck Meynand, Saint Didier de Formans (FR)

(73) Assignee: Danfoss Commercial Compressors, Reyrieux (FR)

( * ) Notice: Subject to any disclaimer, the term of this patent is extended or adjusted under 35 U.S.C. 154(b) by 12 days.

(21) Appl. No.: 13/994,912

(22) PCT Filed: Nov. 28, 2011

(86) PCT No.: PCT/FR2011/052785

§ 371 (c)(1),
(2), (4) Date: Jul. 22, 2013

(87) PCT Pub. No.: WO2012/080612

PCT Pub. Date: Jun. 21, 2012

(65) Prior Publication Data

US 2013/0302198 A1 Nov. 14, 2013

(30) Foreign Application Priority Data

Dec. 16, 2010 (FR) ..... 10 60590

(51) Int. Cl.
*F01C 1/02* (2006.01)
*F03C 2/00* (2006.01)
(Continued)

(52) U.S. Cl.
CPC ..... *F04C 18/0207* (2013.01); *F04C 18/0253* (2013.01); *F04C 18/0261* (2013.01); *F04C 23/008* (2013.01); *F04C 28/26* (2013.01); *F04C 29/128* (2013.01); *F04C 18/0215* (2013.01)

(58) Field of Classification Search
USPC ..... 418/15, 55.1–55.6, 57, 180, 270, 418/DIG. 1; 417/307, 308, 310, 410.5, 440
See application file for complete search history.

(56) References Cited

U.S. PATENT DOCUMENTS 4,696,630 A * 9/1987 Sakata et al. ..... 418/55.5
5,090,880 A 2/1992 Mashimo (Continued)

FOREIGN PATENT DOCUMENTS

JP S63-117187 A 5/1988
JP H08-247053 A 9/1996

(Continued)

OTHER PUBLICATIONS

French Preliminary Search Report issued in Application No. 1060590; Dated Jul. 8, 2011.

(Continued)

*Primary Examiner* — Theresa Trieu
(74) *Attorney, Agent, or Firm* — Oliff PLC

(57) ABSTRACT

The scroll refrigeration compressor includes a stationary volute and a moving volute provided with spiral wraps defining variable-volume compression chambers, a separating member sealably mounted on a plate of the stationary volute so as to allow a relative movement between the separating member and the stationary volute, a delivery chamber at least partially defined by the separating member and the sealed casing. The compressor further includes a bypass passage arranged to communicate the delivery chamber with an intermediate compression chamber, and a anti-return device comprising a closing member movable between closing and opening positions for closing and opening the bypass passage, and an enclosure, positioned between the separating member and the plate of the stationary volute, including a first portion sealably mounted in a housing defined by the separating member and oriented substantially parallel to the longitudinal axis of the compressor.

15 Claims, 4 Drawing Sheets

(51) Int. Cl.

| | |
|---|---|
| ***F04C 2/00*** | (2006.01) |
| ***F04C 18/02*** | (2006.01) |
| ***F04C 28/26*** | (2006.01) |
| ***F04C 29/12*** | (2006.01) |
| *F04C 23/00* | (2006.01) |

(56) References Cited

U.S. PATENT DOCUMENTS

| | | | | | |
|---|---|---|---|---|---|
| 5,169,294 | A | * | 12/1992 | Barito | 417/310 |
| 5,567,137 | A | * | 10/1996 | Nakashima et al. | 418/55.5 |
| 5,674,058 | A | | 10/1997 | Matsuda et al. | |
| 5,855,475 | A | | 1/1999 | Fujio et al. | |
| 6,227,830 | B1 | * | 5/2001 | Fields et al. | 418/55.1 |
| 6,494,688 | B1 | | 12/2002 | Barito et al. | |
| 2007/0217938 | A1 | | 9/2007 | Cho | |
| 2009/0041603 | A1 | * | 2/2009 | Ginies et al. | 418/55.6 |
| 2009/0185926 | A1 | | 7/2009 | Bush | |
| 2010/0215535 | A1 | | 8/2010 | Kiyokawa et al. | |

FOREIGN PATENT DOCUMENTS

| | | | | | |
|---|---|---|---|---|---|
| JP | 10077977 | A | * | 3/1998 | F04C 18/02 |
| JP | H11-324950 | A | | 11/1999 | |
| JP | 2002/364565 | A | | 12/2002 | |
| JP | 2003254267 | A | * | 9/2003 | F04C 18/02 |

OTHER PUBLICATIONS

International Search Report issued in Application No. PCT/FR2011/052785; Dated Mar. 5, 2013 (With Translation).

Jul. 20, 2011 Preliminary Search Report issued in French Patent Application No. 1060594.

Nov. 7, 2014 Office Action issued in U.S. Appl. No. 13/994,952.

Mar. 5, 2013 International Search Report issued in International Patent Application No. PCT/FR2011/052777.

Oct. 24, 2014 Office Action issued in U.S. Appl. No. 13/994,875.

* cited by examiner

SCROLL REFRIGERATION COMPRESSOR WITH ANTI-RETURN DEVICE

BACKGROUND

The present invention relates to a scroll refrigeration compressor.

In a known manner, a scroll refrigeration compressor comprises a sealed casing containing a stationary volute and moving volute following an orbital movement, each volute including a plate from which a spiral wrap extends, the spiral wraps of the stationary and moving volutes being engaged in one another and defining variable-volume compression chambers, the compression chambers having a volume that decreases gradually from the outside, where the refrigerant gas is admitted, toward the inside.

Thus, during the relative orbital movement of the first and second volutes, the refrigerant gas is compressed due to the decrease in the volume of the compression chambers and conveyed to the center of the first and second volutes. The compressed refrigerant gas leaves from the central part toward a delivery chamber through a delivery conduit formed in the central part of the first volute.

In order to improve the performance of such a compressor depending on the season, and more particularly depending on the demand for cold, this compressor may have a variable capacity and/or a variable compression rate.

DESCRIPTION OF RELATED ART

Document U.S. Pat. No. 5,855,475 describes a scroll refrigeration compressor with a variable compression rate on the one hand comprising refrigerant fluid passage orifices formed in the plate of the stationary volute and each respectively emerging in one of the compression chambers and in the delivery chamber, and on the other hand bypass valves disposed on the surface of the plate of the stationary volute turned toward the side opposite the spiral wraps and each movable between an open position, allowing refrigerant fluid to be delivered from the corresponding compression chamber to the delivery chamber, and a closed position, preventing refrigerant fluid from being delivered from the corresponding compression chamber to the delivery chamber.

When one of the bypass valves is subjected, on the face thereof turned toward the plate of the stationary volute, to a pressure lower than the pressure in the delivery chamber, said valve is kept in its closed position and isolates the corresponding compression chamber from the delivery chamber. As a result, the compression rate of the compressor is kept at its maximum value.

When one of the bypass valves is subjected, on the face thereof turned toward the plate of the stationary volute, to a pressure higher than the pressure in the delivery chamber, said valve deforms elastically toward the open position thereof and communicates the corresponding compression chamber with the delivery chamber. This therefore results in a delivery to the delivery chamber of part of the refrigerant fluid compressed in the compression chambers in which the passage orifices emerge before that part of the refrigerant fluid reaches the center of the spiral wraps.

The presence of such passage orifices and such bypass valves makes it possible to decrease the compression rate of each compression chamber as a function of the operating conditions, and to thereby avoid over-compressing the refrigerant fluid. These arrangements must make it possible to improve the energy output of the compressor.

In order to decrease the mechanical forces exerted on the stationary volute, and therefore on the moving volute and the drive shaft of the moving volute, it is known to mount a separating member on the face of the plate of the stationary volute turned toward the delivery chamber such that said delivery chamber is at least partially defined by the sealed casing of the compressor and the separating member. The presence of such a separating member thereby makes it possible to increase the reliability of the compressor.

Furthermore, in order to still further improve the reliability of the compressor, it is known to mount the separating member movably with respect to the stationary volute in a direction substantially parallel to the longitudinal axis of the compressor.

Installing bypass valves, as described in document U.S. Pat. No. 5,855,475, on the upper surface of a stationary volute of the compressor equipped with a separating member is difficult, or even impossible, due to the fact that access to the upper surface of the stationary volute is hindered by the presence of the separating member.

SUMMARY

The present invention aims to resolve these drawbacks.

The technical problem at the base of the invention therefore consists of providing a scroll refrigeration compressor that has a simple and cost-effective structure, and that makes it possible to improve the performance of the compressor, while allowing a simple and easy assembly of an anti-return device on the stationary volute of the compressor.

To that end, the present invention relates to a scroll refrigeration compressor comprising:

- a sealed casing containing a stationary volute and a moving volute following an orbital movement, each volute including a plate from which a spiral wrap extends, the spiral wraps of the stationary and moving volutes being engaged in one another and defining variable-volume compression chambers,
- a separating member sealably mounted on the plate of the stationary volute so as to allow a relative movement between the separating member and the stationary volute in a direction substantially parallel to the longitudinal axis of the compressor, the separating member and the plate of the stationary volute delimiting an intermediate volume,
- a delivery chamber at least partially defined by the separating member and the sealed casing, characterized in that the compressor further comprises:

- at least one bypass passage arranged to communicate the delivery chamber with an intermediate compression chamber,
- at least one anti-return device of a first type associated with a bypass passage, each anti-return device of the first type comprising a closing member movable between closing and opening positions for closing and opening the corresponding bypass passage, and designed to be moved into the opening position thereof when the pressure in the intermediate compression chamber in which the corresponding bypass passage emerges exceeds the pressure in the delivery chamber by a predetermined value, each anti-return device of the first type including an enclosure positioned between the separating member and the plate of the stationary volute, the enclosure of each anti-return device of the first type including a first portion mounted at least partially and sealably in a housing defined by the separating member and oriented substantially parallel to the longitudinal axis of the compressor, said housing in which the first portion of said enclosure is mounted emerging in the delivery chamber.

The fact that each anti-return device of the first type includes an enclosure arranged to be sealably mounted in a housing defined by the separating member and oriented substantially parallel to the longitudinal axis of the compressor allows a simple and quick assembly of each anti-return device of the first type, despite the presence of a separating member.

In fact, the positioning of the different anti-return devices of the first type may be done either by pre-assembling each anti-return device of the first type in the corresponding housing defined by the separating member before inserting the latter into the casing of the compressor, then assembling said separating member on the plate of the stationary volute, or by assembling each anti-return device of the first type on the plate of the stationary volute in a predetermined position, then positioning the different housings defined by the separating member across from the corresponding anti-return devices and moving the latter toward the plate of the stationary volute in a direction substantially parallel to the longitudinal axis of the compressor until each anti-return device is inserted in the corresponding housing delimited by the separating member.

This results in a simple and quick assembly of each anti-return device of the first type, despite the presence of a separating member.

An intermediate compression chamber refers to a compression chamber having a pressure comprised between the pressure of the first compression chamber "said to be the displacement pressure" and the pressure of the last compression chamber emerging in the delivery conduit.

Preferably, each bypass passage extends at least partially through the separating member.

Advantageously, the intermediate volume defined by the separating member and the plate of the stationary volute is fluidly isolated from the delivery chamber.

According to one embodiment of the invention, the enclosure of each anti-return device of the first type is movably mounted with respect to the separating member and/or the plate of the stationary volute in a direction substantially parallel to the longitudinal axis of the compressor.

Preferably, each bypass passage includes a bypass conduit formed in the plate of the stationary volute and comprising a first end emerging in the corresponding intermediate compression chamber and a second end emerging in the face of the plate of the stationary volute turned toward the delivery chamber, the enclosure of each anti-return device of the first type includes a first refrigerant passage orifice arranged to fluidly connect the corresponding bypass conduit to the delivery chamber, and the closing member for each anti-return device is movable between closing and opening positions for closing and opening the first refrigerant fluid passage orifice.

Preferably, the closing member of each anti-return device is assembled inside the corresponding enclosure.

Preferably, the closing member of each anti-return device is a check valve. Each check valve is for example made in the form of a strip elastically deformable between the closing and opening positions thereof.

Advantageously, the enclosure of each anti-return device of the first type defines an inner volume and includes a second refrigerant fluid passage orifice arranged to fluidly connect the inner volume to the delivery chamber, the first passage orifice being arranged to fluidly connect the inner volume to the corresponding bypass conduit.

Advantageously, the enclosure of each anti-return device of the first type includes a first portion sealably and at least partially mounted in a housing defined by the separating member and emerging in the delivery chamber, each housing in which the first portion of the corresponding enclosure is mounted being oriented substantially parallel to the longitudinal axis of the compressor.

Preferably, the second refrigerant fluid passage orifice of the enclosure of each anti-return device of the first type is formed at least partially in the first portion of the enclosure and is arranged to emerge in the delivery chamber.

According to one embodiment of the invention, the first portion of the enclosure of each anti-return device of the first type is slidingly mounted substantially parallel to the axis of the compressor in the corresponding housing defined by the separating member.

Preferably, the compressor comprises elastic means disposed between the separating member and the enclosure of each anti-return device of the first type, and arranged to bias said enclosure against the plate of the stationary volute. The elastic means for example include a spiral spring.

According to one embodiment of the invention, the enclosure of each anti-return device of the first type is movable with respect to the plate of the stationary volute between a first position, in which it sealably bears against the plate of the stationary volute, and a second position, in which said enclosure is situated at a distance from the plate of the stationary volute and arranged to communicate the corresponding bypass conduit with the intermediate volume defined by the separating member and the plate of the stationary volute. These arrangements make it possible to ensure, under non-optimal operating conditions (i.e., when the pressure in the corresponding intermediate compression chamber reaches a very high value), the leakage flow rate toward the intermediate volume, which is generally connected to a low-pressure suction volume, which makes it possible to limit the mechanical forces exerted on the different bearings guiding the driveshaft of the moving volume, and therefore to still further improve the reliability of the compressor.

According to one embodiment of the invention, the first portion of the enclosure of each anti-return device of the first type includes a first tubular part turned toward the side of the plate of the stationary volute, and a second tubular part extending the first tubular part and having outer dimensions smaller than those of the first tubular part, at least the second tubular part of said first portion being sealably mounted in the corresponding housing defined by the separating member. These arrangements prevent the enclosure of each anti-return device of the first type from moving beyond the separating member.

Advantageously, each housing in which the first portion of the corresponding enclosure is mounted is defined by a tubular portion complementary to the first tubular part of said first portion and in which said first tubular part is mounted, and a bottom wall extending from the end of the tubular portion turned toward the delivery chamber and transversely to said tubular portion, the bottom wall including an assembly orifice emerging on the one hand in the delivery chamber and on the other hand in the tubular portion, the assembly orifice having a shape complementary to the second tubular part of said first portion and housing said second tubular part.

According to one embodiment of the invention, the enclosure of each anti-return device of the first type includes a second portion mounted at least partially and sealably in a housing formed in the face of the plate of the stationary volute turned toward the delivery chamber.

Preferably, the first refrigerant fluid passage orifice of the enclosure of each anti-return device of the first type is formed in the second portion of said enclosure and is arranged to emerge in the corresponding bypass conduit.

According to a first alternative, at least one part of the second portion of the enclosure of each anti-return device of the first type is forcibly mounted in the corresponding housing formed in the plate of the stationary volute, and the first portion of said enclosure is slidingly mounted parallel to the axis of the compressor and the corresponding housing defined by the separating member.

According to a second alternative, the second portion of the enclosure of each anti-return device of the first type is slidingly mounted parallel to the axis of the compressor in the corresponding housing formed in the plate of stationary volute, and the first portion of said enclosure is forcibly mounted in the corresponding housing defined by the separating member.

According to a third alternative, the second portion of the enclosure of each anti-return device of the first type is slidingly mounted parallel to the axis of the compressor and the corresponding housing formed in the plate of the stationary volute, and the first portion of said enclosure is slidingly mounted parallel to the axis of the compressor in the corresponding housing defined by the separating member.

According to another embodiment of the invention, the compressor comprises a support member sealably mounted on the face of the plate of the stationary volute turned toward the delivery chamber, the support member defining at least one housing in which the enclosure of an anti-return device of the first type is at least partially mounted. Preferably, the support member is mounted in a slot with a complementary shape formed in the face of the plate of the stationary volute turned toward the delivery chamber. The support member is for example annular. The support member advantageously includes, at each housing in which an anti-return device of the first type is mounted, a through opening emerging in the corresponding housing and arranged to communicate said housing with the corresponding bypass conduit.

According to this embodiment, the enclosure of each anti-return device of the first type includes a third fluid passage orifice arranged to fluidly connect the first passage orifice with the corresponding through opening.

Advantageously, the plate of the stationary volute has a pressure equalization conduit including a first end emerging in the intermediate volume defined by the separating member and the plate of the stationary volute and a second end emerging in a suction volume at least partially defined by the moving volute and the face of the plate of the stationary volute turned toward the moving volute.

Preferably, the compressor includes:

at least one injection passage arranged to communicate the intermediate volume defined by the separating member and the plate of the stationary volute with an intermediate compression chamber, and at least one anti-return device of a second type associated with an injection passage, each anti-return device of the second type comprising a closing member movable between closing and opening positions for closing and opening the corresponding injection passage, and designed to be moved into the opening position thereof when the pressure in the intermediate volume exceeds the pressure in the intermediate compression chamber in which the corresponding injection passage emerges by a predetermined value.

When the compressor includes an annular support member, the latter advantageously defines at least one housing in which an anti-return device of the second type is mounted.

According to one advantageous feature of the invention, the compressor comprises sealing means disposed between the enclosure of each anti-return device of the first type and the separating member and/or between the enclosure of each anti-return device of the first type and the plate of the stationary volute. These arrangements make it possible to ensure sealing assembly of each anti-return device, despite any alignment defects between the various housings designed to receive the enclosures of the anti-return devices.

According to another advantageous feature of the invention, the compressor comprises sealing means disposed between the separating member and the plate of the stationary volute.

In any case, the invention will be well understood using the following description done in reference to the appended diagrammatic drawing showing, as non-limiting examples, several embodiments of this scroll refrigeration compressor.

DETAILED DESCRIPTION

In the following description, the same elements are designated using the same references in the various embodiments.

Figure 1:
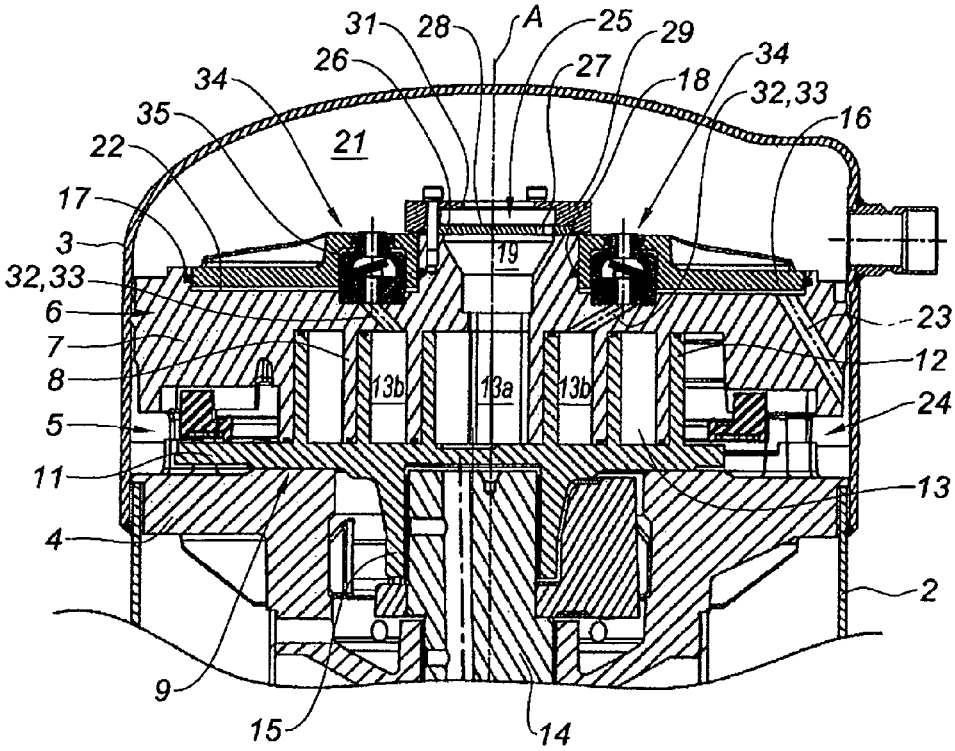
FIG. 1 is a partial longitudinal cross-sectional view of a scroll refrigeration compressor according to a first embodiment of the invention.
Figure 2A:
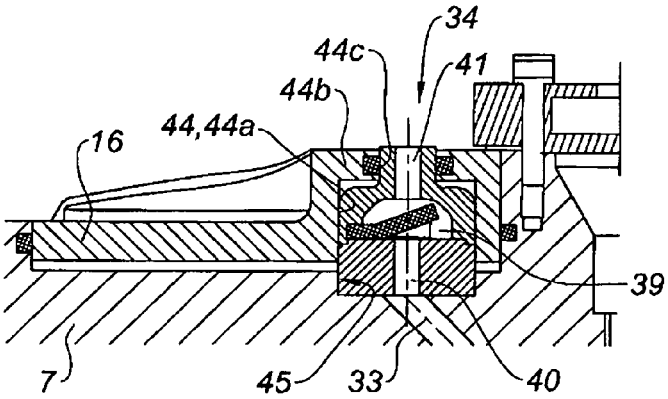
FIG. 2*a* is an enlarged view of a detail of FIG. 1.
Figure 2B:
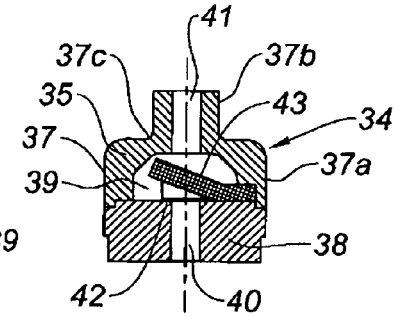
FIG. 2*b* is an enlarged view of an anti-return device of the compressor of FIG. 1.

FIG. 1 describes a scroll refrigeration compressor in a vertical position. However, the compressor according to the invention may be in an inclined position or horizontal position, without the structure being significantly modified.

The compressor shown in FIG. 1 comprises a sealed casing delimited by a shell 2 whereof the upper and lower ends are respectively closed by a cover 3 and a base (not shown in FIG. 1). The assembly of this casing may in particular be done using weld seams.

The intermediate part of the compressor is occupied by a body 4 that is used to mount a refrigerant gas compression stage 5. This compression stage 5 comprises a stationary volute 6 including a plate 7 from which a stationary spiral wrap 8 extends turned downward, and a moving volute 9 including a plate 11 bearing against the body 4 and from which a spiral wrap 12 extends turned upward. The two spiral wraps 8 and 12 of the two volutes penetrate one another to form variable-volume compression chambers 13.

The compressor comprises an electric motor (not shown in the figures) including a rotor secured to a drive shaft 14 whereof the upper end is off-centered like a crankshaft. This upper part is engaged in a sleeve-forming part 15, included by the moving volute 9. During rotation thereof by the motor, the drive shaft 14 drives the moving volute 9 in an orbital movement.

The compressor comprises a separating member 16 sealably mounted on the plate 7 of the stationary volute 6. The separating member 16 is mounted on the plate 7 of the stationary volute 6 so as to allow a relative movement between the separating member and the stationary volute 6 along the longitudinal axis A of the compressor. In order to ensure sealing between the separating member 16 and the stationary volute 6, the compressor comprises a first annular seal 17 mounted on the plate of the stationary volute and arranged to cooperate with the outer edge of the separating member, and a second annular seal 18 mounted on the plate of the stationary volute and arranged to cooperate with the inner edge of the separating member.

The compressor further comprises a delivery conduit 19 formed in the central part of the stationary volute 6. The delivery conduit 19 comprises a first end emerging in the central compression chamber 13*a* and a second end designed to be communicated with a high-pressure delivery chamber 21 defined by the casing of the compressor, the plate of the stationary volute 6 and the separating member 16. The separating member 16 is mounted on the plate 7 of the stationary volute so as to surround the delivery conduit 19.

The separating member 16 and the plate 7 of the stationary volute 6 define an intermediate volume 22 fluidly isolated from the delivery chamber 21. The plate 7 of the stationary volute 6 includes a pressure equalization conduit 23 including a first end emerging in the intermediate volume 22 defined by the separating member and the plate of the stationary volute, and a second end emerging in a suction volume 24 defined by the body 4, the moving volute 9 and the face of the plate 7 of the stationary volute 6 turned toward the moving volute.

The compressor comprises a valve arrangement 25. The valve arrangement 25 includes a valve plate 26 in the form of a disk mounted on the plate 7 of the stationary volute 6 at the second end of the delivery conduit 19. The valve plate 26 comprises a plurality of delivery openings 27 arranged to communicate the delivery conduit 19 and the delivery chamber 21.

The valve arrangement 25 also includes a delivery valve 28 movable between a closing position, in which the delivery valve 28 seals the delivery openings 27, and an opening position, in which the delivery valve 28 opens the delivery openings 27. The delivery valve 28 is designed to be moved into its opening position when the pressure in the delivery conduit 19 exceeds the pressure in the delivery chamber 21 by a predetermined value substantially corresponding to the adjustment pressure of the delivery valve 28. The delivery valve 28 for example is substantially disk-shaped.

The compressor also comprises a retaining plate 29 mounted on the valve plate 26 and designed to serve as an abutment for the delivery valve 28 when it is in its opening position. The retaining plate 29 comprises at least one passage opening 31 arranged to allow a flow of refrigerant fluid from the delivery openings 27 toward the delivery chamber 21. The retaining plate 29 is arranged to limit the travel of the separating member 16 with respect to the plate 7 of the stationary volute. In fact, the lower face of the retaining plate forms an abutment arranged to cooperate with the upper face of the separating member.

The compressor further comprises two bypass passages 32 arranged respectively to communicate the delivery chamber 21 with an intermediate compression chamber 13*b*. Each bypass passage 32 is formed by a bypass conduit 33 formed in the plate of the stationary volute and comprising a first end emerging in the corresponding intermediate compression chamber 13*b* and a second end emerging in the surface of the plate 7 of the stationary volute 6 turned toward the delivery chamber 21.

The compressor further comprises two anti-return devices 34 each associated with the bypass passage 32.

Each anti-return device 34 comprises a generally cylindrical enclosure 35 comprising a first portion 37 and a second portion 38 defining an inner volume 39. The second portion 38 of the enclosure of each anti-return device 34 is disk-shaped, and comprises a first refrigerant fluid passage orifice 40 emerging in the inner volume 39 and arranged to fluidly connect the inner volume 39 to the corresponding bypass conduit 33. The first portion 37 of the enclosure of each anti-return device 34 includes a second refrigerant fluid passage orifice 41 emerging in the inner volume 39 and arranged to fluidly connect the inner volume 39 to the delivery chamber 21. The first portion 37 of the enclosure of each anti-return device 34 is advantageously formed by a first tubular part 37*a* turned toward the side of the second portion 38 of said enclosure, and a second tubular part 37*b* extending the first tubular part 37*a* and having an outer diameter smaller than that of the first tubular part. The first and second tubular parts 37*a* and 37*b* define a shoulder 37*c*.

The enclosure 35 of each anti-return device 34 further includes an anti-return valve 42 movable between closing and opening positions for closing and opening the first fluid passage orifice 40. Each anti-return valve 42 is designed to be moved into its opening position when the pressure in the intermediate compression chamber 13*b* in which the corresponding bypass passage 33 emerges exceeds the pressure in the delivery chamber 21 by a predetermined value substantially corresponding to the adjustment pressure of said anti-return valve 42. Furthermore, each anti-return valve 42 is advantageously made in the form of a strip elastically deformable between the closing and opening positions thereof.

The enclosure 35 of each anti-return device 34 further includes a retaining plate 43 designed to serve as an abutment for the check valve 42 when it is in the opening position thereof.

The enclosure 35 of each anti-return device 34 is sealably mounted on the one hand on the separating member 16 and on the other hand on the plate 7 of the stationary volute 6. More specifically, the first portion 37 of the enclosure 35 of each anti-return device 34 is slidingly and sealably mounted in a housing 44 with a complementary shape defined by the separating member 16, oriented parallel to the longitudinal axis of the compressor and emerging in the delivery chamber 21, while part of the second portion 38 of the enclosure 35 of each anti-return device 34 is forcibly and sealably mounted in a housing 45 with a complementary shape formed in the face of the plate 7 of the stationary volute 6 turned toward the delivery chamber, oriented parallel to the longitudinal axis of the compressor, and in which the corresponding bypass conduit 33 emerges.

Each housing 44 in which the first portion 37 of the corresponding enclosure 35 is mounted is defined by a complementary tubular portion 44*a* of the first tubular part 37*a* of said first portion 37, and by a bottom wall 44*b* extending transversely to the tubular portion 44*a* from the end thereof turned toward the delivery chamber. The bottom wall 44*b* includes an assembly orifice 44*c* emerging on the one hand in the delivery chamber 21 and on the other hand in the tubular portion 44*a*, the assembly orifice 44*c* having a shape complementary to the second tubular portion 37*b* of said first portion and housing said second tubular portion 37*b*.

In order to ensure sealing between the first portion 37 of each enclosure 35 and the separating member 16, the bottom wall 44*b* includes an annular groove in which an annular seal is mounted arranged to cooperate with the first portion 37 of the corresponding enclosure.

It must be noted that each bypass passage 32 is formed on the one hand by the corresponding bypass conduit 33, and on the other hand by the first and second passage orifices 40, 41 and the inner volume 39 of the enclosure 35 of the corresponding anti-return device 34.

The operation of the scroll compressor will now be described.

When the scroll compressor according to the invention is started, the moving volute 9 is driven by the drive shaft 14 in an orbital movement, this movement of the moving volute causing an intake and compression of refrigerant fluid in the variable-volume compression chambers 13.

Under optimal operating conditions, each check valve 42 is subject, on the face thereof turned toward the plate 7 of the stationary volute 6, to a pressure lower than the pressure in the delivery chamber 21. Thus, said bypass valves 42 are kept in their closing position and consequently isolate the intermediate compression chambers 13*b* in which the corresponding bypass passages 32 emerge.

As a result, all of the refrigerant fluid compressed in the compression chambers 13 reaches the center of the spiral wraps and escapes through the delivery conduit 19 toward the delivery chamber 21 by moving the delivery valve 28 into the opening position thereof, and lastly by flowing axially through the delivery openings 27 and the passage openings 31.

Under non-optimal operating conditions, for example seasonally, during startup, or during deicing of the compressor, each check valve 42 may be subject, on the face thereof turned toward the plate 7 of the stationary volute 6, to a pressure higher than the pressure in the delivery chamber 21. In that scenario, the check valves 42 deform elastically toward the opening position thereof and communicate the intermediate compression chambers 13*b* in which the corresponding bypass passages 32 emerge with the delivery chamber 21. This thereby results in a delivery to delivery chamber of part of the refrigerant fluid compressed in the intermediate compression chambers 13*b* in which the bypass passages 32 emerge before that part of the refrigerant fluid reaches the center of the spiral wraps.

Figure 3:
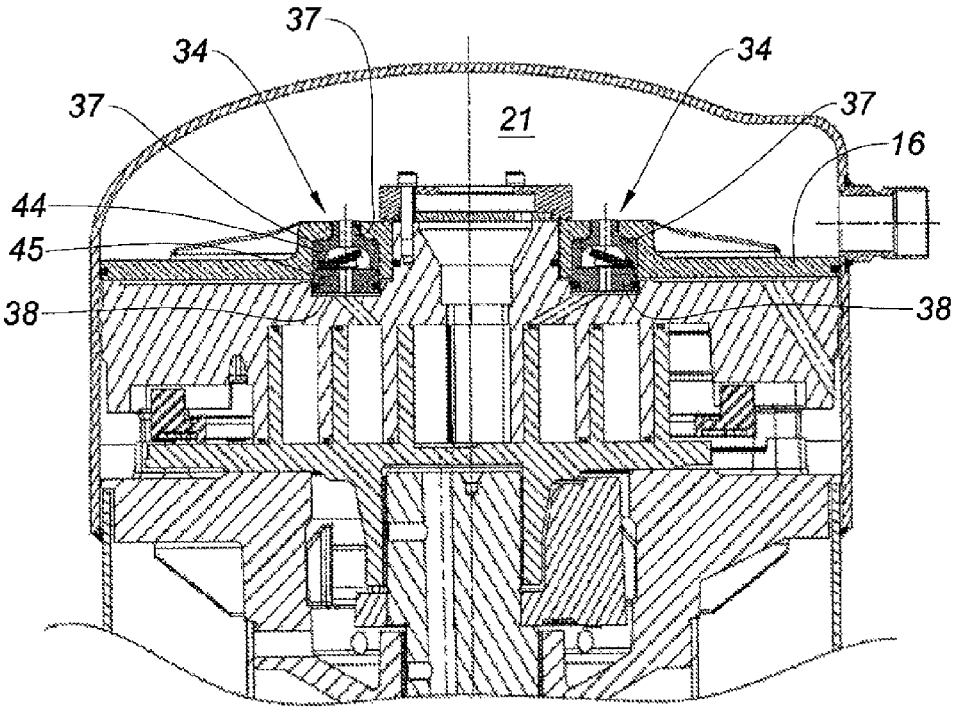
FIG. 3 is a partial longitudinal cross-sectional view of a scroll refrigeration compressor according to a second embodiment of the invention.

FIG. 3 shows a compressor according to a second embodiment of the invention that differs from that shown in FIG. 1 essentially in that the outer edge of the separating member 16 sealably cooperates with the inner wall of the cover 3, and in that the first portion 37 of the enclosure 35 of each anti-return device 34 is forcibly mounted in the corresponding housing 44 defined by the separating member 16, and the second portion 38 of said enclosure 35 is slidingly mounted parallel to the axis of the compressor in the corresponding housing 45 formed in the plate 7 of the stationary volute 6. In order to ensure sealing between the second portion 38 of each enclosure 35 and the plate 7 of the stationary volute 6, the second portion 38 of each enclosure includes, on the outer surface thereof, an annular groove in which an annular seal is mounted.

Figure 4:
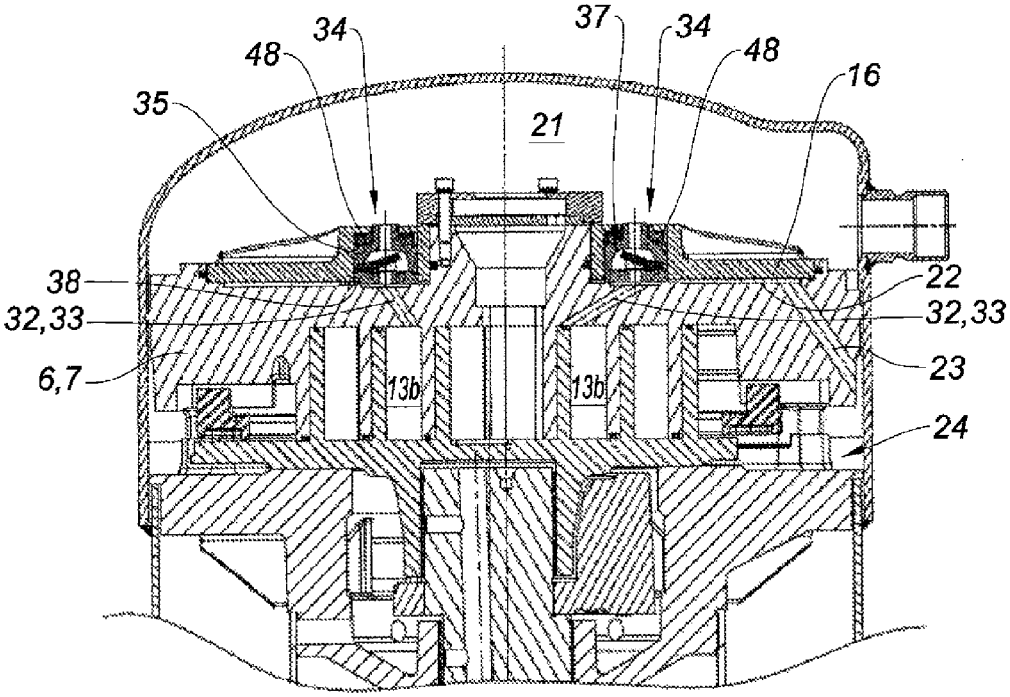
FIG. 4 is a partial longitudinal cross-sectional view of a scroll refrigeration compressor according to a third embodiment of the invention.

FIG. 4 shows a compressor according to a third embodiment of the invention that differs from that shown in FIG. 1 essentially in that the compressor comprises elastic means arranged to bias the enclosure of each anti-return device 34 against the plate 7 of the stationary volute, and in that the second portion 38 of the enclosure 35 of each anti-return device 34 is not mounted in a housing formed in the plate of the stationary volute.

Preferably, the elastic means include a spiral spring 48 disposed around the second tubular part 37*b* of the first portion 37 of the enclosure 35 of each anti-return device 34, and respectively bearing against the corresponding bottom wall 44*b* and the corresponding shoulder 37*c*.

According to this embodiment, the enclosure 35 of each anti-return device 34 is movable with respect to the plate 7 of the stationary volute 6 between a first position, in which it sealably bears against the plate 7 of the stationary volute 6, and a second position, in which said enclosure is situated at a distance from the plate of the stationary volute and arranged to communicate the corresponding bypass conduit 33 with the intermediate volume 22 defined by the retaining plate 16 and the plate 7 of the stationary volute 6.

Thus, when the enclosure 35 of each anti-return device 34 is subjected, on the face thereof turned toward the plate 7 of the stationary volute 6, to a force greater than the resultant of the forces applied on the antagonistic faces of said enclosure, said enclosure moves at a distance from the plate 7 of the stationary volute 6 so as to communicate the corresponding bypass conduit 33 with the intermediate volume 22.

Figure 5:
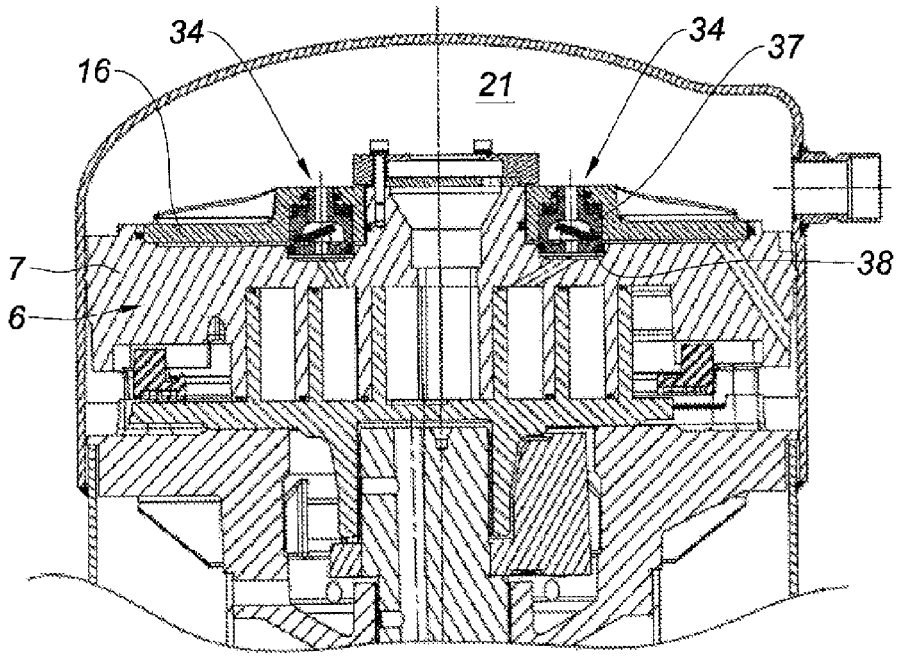
FIG. 5 is a partial longitudinal cross-sectional view of a scroll refrigeration compressor according to a fourth embodiment of the invention.

FIG. 5 shows a compressor according to a fourth embodiment of the invention that differs from that shown in FIG. 1 essentially in that the second portion 38 of the enclosure 35 of each anti-return device 34 is also slidingly mounted parallel to the axis of the compressor in the corresponding housing 45 formed in the plate 7 of the stationary volute 6.

Figure 6:
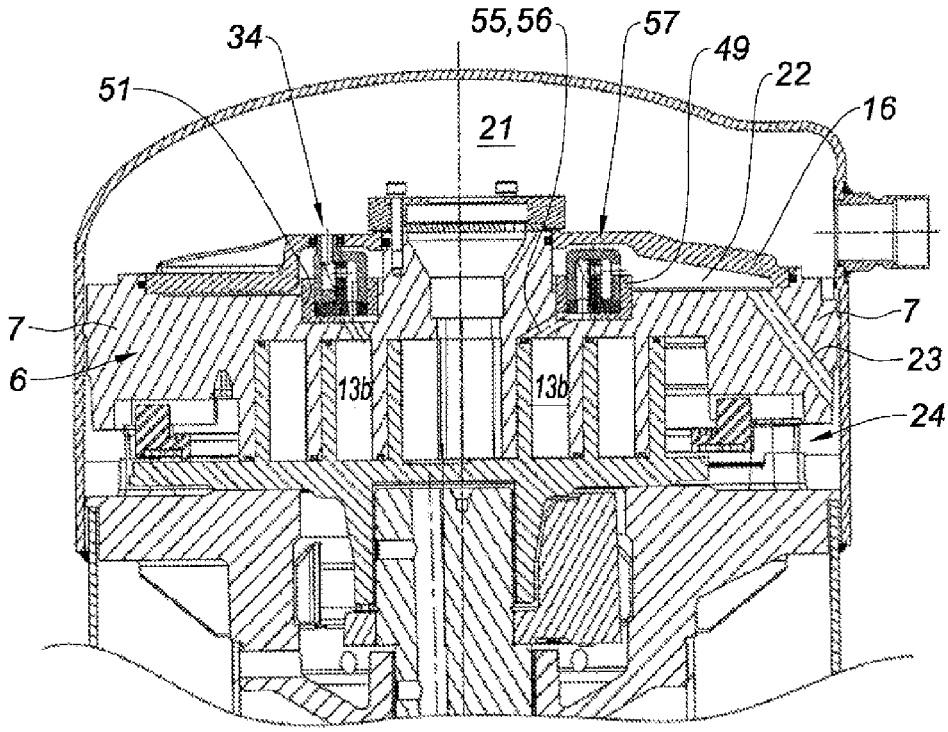
FIG. 6 is a partial longitudinal cross-sectional view of a scroll refrigeration compressor according to a fifth embodiment of the invention.
Figure 7:
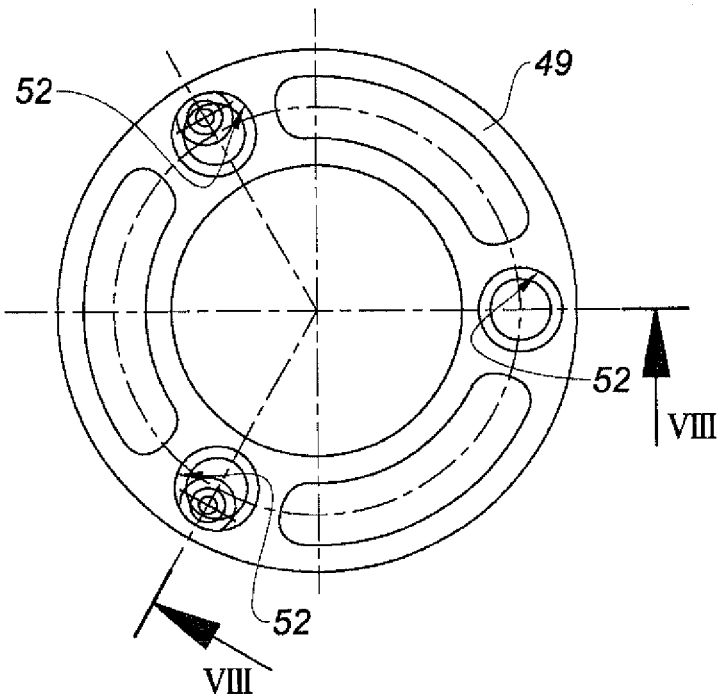
FIG. 7 is a top view of a support member equipped with two anti-return devices of the first type and one anti-return device of the second type.
Figure 8:
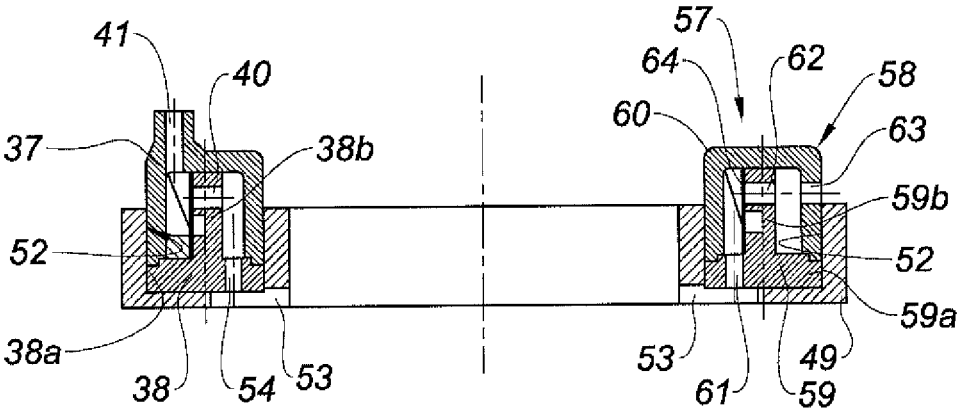
FIG. 8 is a cross-sectional view of the support member along line VIII-VIII of FIG. 7.

FIGS. 6 to 8 show a compressor according to a fifth embodiment of the invention that differs from that shown in FIG. 1 essentially in that the compressor comprises an annular support member 49 mounted in an annular slot 51 with a complementary shape formed in the face of the plate 7 of the stationary volute 6 turned toward the delivery chamber 21. The support member 49 defines three cylindrical housings 52 regularly spaced apart, two of which are designed to house an anti-return device 34.

The support member 49 further includes three through openings 53 each emerging in one of the housings 52 formed in the support member 49. The through openings 53 that emerge in the housings 52 designed to house an anti-return device 34 are arranged to emerge in the corresponding bypass conduit 33.

According to this fifth embodiment, the second portion 38 of each anti-return device 34 includes a first disk-shaped part 38*a* extending substantially perpendicular to the longitudinal axis A of the compressor and a second part 38*b* extending substantially parallel to the longitudinal axis of the compressor and from the first disk-shaped part 38*a*. The first disk-shaped part 38*a* of the enclosure 35 of each anti-return device 34 includes a third fluid passage openings 54 arranged to fluidly connect the first passage opening 40 with the corresponding through opening 53.

It should be noted that, according to this fifth embodiment, only the second tubular part 37*b* of the enclosure 35 of each anti-return device 34 is slidingly mounted in the corresponding housing 45 defined by the separating member 16, said housing being formed only by an assembly orifice 44*c* formed in the separating member 16.

The compressor further includes an injection passage 55 arranged to communicate the intermediate volume 22 defined by the separating member 16 and the plate 7 of the stationary volute 6 with an intermediate compression chamber 13*b*. The injection passage 55 includes an injection conduit 56 formed in the plate 7 of the stationary volute 6 and comprising a first end emerging in the corresponding intermediate compression chamber 13*b* and a second end emerging in the annular slot 51 across from a through opening 53.

The compressor also includes an anti-return device 57 of a second type associated with the injection passage 55. The anti-return device 57 is mounted in a housing 52 formed in the support member 49.

The anti-return device 57 includes an enclosure 58 comprising a first portion 59 and a second portion 60. The first portion 59 includes a first disk-shaped part 59*a* extending substantially perpendicular to the longitudinal axis A of the compressor and a second part 59*b* extending substantially parallel to the longitudinal axis of the compressor and from the first disk-shaped part 59*a*. The first disk-shaped part 59*a* includes a first fluid passage orifice 61 fluidly connected to the corresponding through opening 53. The second part 59*b* includes a second fluid passage orifice 62 fluidly connected to a third fluid passage orifice 63 formed in the second portion 60 and emerging in the intermediate volume 22 defined by the separating member and the plate 7 of the stationary volute 6.

The enclosure 58 further includes a check valve 64 movable between closing and opening positions for closing and opening the second fluid passage orifice 62. The check valve 64 is designed to be moved into its opening position when the pressure in the intermediate volume 22 exceeds the pressure in the intermediate compression chamber in which the corresponding injection passage 55 emerges by a predetermined value. Furthermore, the check valve 64 is advantageously made in the form of a strip elastically deformable between the closing and opening positions thereof.

It should be noted that the injection passage 55 is partially formed on the one hand by the injection conduit 56, and on the other hand by the first, second and third passage orifices of the enclosure 58 of the anti-return device 57.

The invention is of course not limited solely to the embodiments of the scroll refrigeration compressor described above as examples, but on the contrary encompasses all alternative embodiments.

The invention claimed is:

1. A scroll refrigeration compressor comprising:

a sealed casing containing a stationary volute and a moving volute following an orbital movement, each volute including a plate from which a spiral wrap extends, the spiral wrap of the stationary volute and the spiral wrap of the moving volute being engaged in one another and defining variable-volume compression chambers;

a separating member sealably mounted on the plate of the stationary volute so as to allow a relative movement between the separating member and the stationary volute in a direction parallel to a longitudinal axis (A) of the compressor, the separating member and the plate of the stationary volute delimiting an intermediate volume; and a delivery chamber at least partially defined by the separating member and the sealed casing;

at least one bypass passage arranged to communicate the delivery chamber with an intermediate compression chamber; and at least one anti-return device of a first type associated with a bypass passage, each anti-return device of the first type comprising a closing member movable between closing and opening positions for closing and opening the corresponding bypass passage, and configured to be moved into the opening position when the pressure in the intermediate compression chamber in which the corresponding bypass passage emerges exceeds the pressure in the delivery chamber by a predetermined value, each anti-return device of the first type including an enclosure positioned between the separating member and the plate of the stationary volute, the enclosure of each anti-return device of the first type including a first portion mounted at least partially and sealably in a housing defined by the separating member and oriented parallel to the longitudinal axis of the compressor, said housing in which the first portion of said enclosure is mounted emerging in the delivery chamber.

2. The compressor according to claim 1, wherein the enclosure of each anti-return device of the first type is movably mounted with respect to the separating member and/or the plate of the stationary volute in a direction parallel to the longitudinal axis of the compressor.

3. The compressor according to claim 1, wherein each bypass passage includes a bypass conduit formed in the plate of the stationary volute and comprising a first end emerging in the corresponding intermediate compression chamber and a second end emerging in a face of the plate of the stationary volute turned toward the delivery chamber, the enclosure of each anti-return device of the first type includes a first refrigerant fluid passage orifice arranged to fluidly connect the corresponding bypass conduit to the delivery chamber, and the closing member of each anti-return device is movable between closing and opening positions for closing and opening the first refrigerant fluid passage orifice.

4. The compressor according to claim 3, wherein the enclosure of each anti-return device of the first type defines an inner volume and includes a second refrigerant fluid passage orifice arranged to fluidly connect the inner volume to the delivery chamber, the first refrigerant fluid passage orifice being arranged to fluidly connect the inner volume to the corresponding bypass conduit.

5. The compressor according to claim 4, wherein the second refrigerant fluid passage orifice of the enclosure of each anti-return device of the first type is formed at least partially in the first portion of the enclosure and is arranged to emerge in the delivery chamber.

6. The compressor according to claim 1, wherein the first portion of the enclosure of each anti-return device of the first type is slidingly mounted parallel to the axis of the compressor in the corresponding housing defined by the separating member.

7. The compressor according to claim 6, wherein the compressor comprises elastic means disposed between the separating member and the enclosure of each anti-return device of the first type, and arranged to bias said enclosure against the plate of the stationary volute.

8. The compressor according to claim 7, wherein the enclosure of each anti-return device of the first type is movable with respect to the plate of the stationary volute between a first position, in which said enclosure sealably bears against the plate of the stationary volute, and a second position, in which said enclosure is situated at a distance from the plate of the stationary volute and arranged to communicate the corresponding bypass conduit with the intermediate volume defined by the separating member and the plate of the stationary volute.

9. The compressor according to claim 1, wherein the first portion of the enclosure of each anti-return device of the first type includes a first tubular part turned toward a side of the plate of the stationary volute, and a second tubular part extending the first tubular part and having outer dimensions smaller than those of the first tubular part, at least the second tubular part of said first portion being sealably mounted in the corresponding housing defined by the separating member.

10. The compressor according to claim 9, wherein each housing in which the first portion of the corresponding enclosure is mounted is defined by a tubular portion complementary to the first tubular part of said first portion and in which said first tubular part is mounted, and by a bottom wall extending from the end of the tubular portion turned toward the delivery chamber and transversely to said tubular portion, the bottom wall including an assembly orifice emerging on the one hand in the delivery chamber and on the other hand in the tubular portion, the assembly orifice having a shape complementary to the second tubular part of said first portion and housing said second tubular part.

11. The compressor according to claim 1, wherein the enclosure of each anti-return device of the first type includes a second portion mounted at least partially and sealably in a housing formed in a face of the plate of the stationary volute turned toward the delivery chamber.

12. The compressor according to claim 11, wherein a first refrigerant fluid passage orifice of the enclosure of each anti-return device of the first type is formed in the second portion of said enclosure and is arranged to emerge in the corresponding bypass conduit.

13. The compressor according to claim 1, wherein the compressor comprises a support member sealably mounted on a face of the plate of the stationary volute turned toward the delivery chamber, the support member defining at least one housing in which the enclosure of an anti-return device of the first type is at least partially mounted.

14. The compressor according to claim 1, wherein the plate of the stationary volute has a pressure equalization conduit including a first end emerging in the intermediate volume defined by the separating member and the plate of the stationary volute and a second end emerging in a suction volume at least partially defined by the moving volute and a face of the plate of the stationary volute turned toward the moving volute.

15. The compressor according to claim 14, wherein the compressor includes:

at least one injection passage arranged to communicate the intermediate volume defined by the separating member and the plate of the stationary volute with an intermediate compression chamber, and at least one anti-return device of a second type associated with an injection passage, each anti-return device of the second type comprising a closing member movable between closing and opening positions for closing and opening the corresponding injection passage, and configured to be moved into the opening position when the pressure in the intermediate volume exceeds the pressure in the intermediate compression chamber in which the corresponding injection passage emerges by a predetermined value.

* * * * *